US006622458B2

(12) United States Patent
Fischer et al.

(10) Patent No.: US 6,622,458 B2
(45) Date of Patent: Sep. 23, 2003

(54) HIGH SPEED FISH CANNING METHOD AND APPARATUS

(75) Inventors: Otto H. Fischer, Seal Beach, CA (US); Edward J. Rowley, Rancho Cucamonga, CA (US)

(73) Assignee: Atlas Pacific Engineering Company, Pueblo, CA (US)

( * ) Notice: Subject to any disclaimer, the term of this patent is extended or adjusted under 35 U.S.C. 154(b) by 38 days.

(21) Appl. No.: 10/006,448

(22) Filed: Nov. 27, 2001

(65) Prior Publication Data

US 2003/0097819 A1 May 29, 2003

(51) Int. Cl.[7] ..... B65B 63/00

(52) U.S. Cl. ..... 53/435; 53/438; 53/473; 53/517; 53/529; 53/252

(58) Field of Search ..... 53/435, 436, 438, 53/439, 473, 113, 513, 517, 529, 530, 247, 249, 250, 251, 252, 516

(56) References Cited

U.S. PATENT DOCUMENTS

| | | | | | |
|---|---|---|---|---|---|
| 2,037,724 | A | * | 4/1936 | Jacobs et al. | 53/517 |
| 2,044,813 | A | * | 6/1936 | Rooney | 53/435 |
| 2,092,786 | A | * | 9/1937 | Taylor | 53/435 |
| 2,211,433 | A | * | 8/1940 | Papendick | 53/516 |
| 2,518,223 | A | * | 8/1950 | Christiansen | 53/517 |
| 3,700,386 | A | * | 10/1972 | Mencacci | 53/517 |
| 4,116,600 | A | * | 9/1978 | Dutton et al. | 53/517 |
| 4,641,487 | A | * | 2/1987 | Darecchio | 53/517 |
| 5,203,141 | A | * | 4/1993 | Berciga et al. | 53/517 |
| 5,887,414 | A | * | 3/1999 | Rowley et al. | 53/517 |
| 6,067,772 | A | * | 5/2000 | Kraft et al. | 53/247 |

FOREIGN PATENT DOCUMENTS

FR 1288473 3/1962

* cited by examiner

*Primary Examiner*—John Sipos
*Assistant Examiner*—Louis Huynh
(74) *Attorney, Agent, or Firm*—Bruce H. Johnsonbaugh

(57) ABSTRACT

A method and apparatus are provided for automatically packaging fish at high speeds into horizontally oriented cans. Speeds of approximately 600 cans per minute may be obtained with the preferred configuration of the present invention, wherein two incoming streams of fish are split into eight lanes, to achieve canning speeds of approximately twice the speed of prior art machines. Each incoming stream of fish is split into four separate processing streams or channels, primarily to reduce the operational speeds of the equipment components. Each incoming stream of fish is split by a first dividing knife into two forming chambers carried by an intermittently moving turning wheel. The fish is split again by knives located at second and third work stations of the rotating turning wheel. Four fish cakes are formed simultaneously at the second and third work stations and simultaneously discharged downwardly into horizontally oriented cans. The preferred configuration uses two symmetrical banks of equipment sharing a common drive so that two incoming streams of fish are split into eight lanes and eight fish cakes are formed and discharged into cans simultaneously.

20 Claims, 18 Drawing Sheets

HIGH SPEED FISH CANNING METHOD AND APPARATUS

BACKGROUND AND BRIEF SUMMARY OF THE INVENTION

The present invention relates generally to fish canning machinery. More particularly, the invention provides a fish canning method and apparatus with considerably increased canning speed capacity while simultaneously minimizing the operational speed of the machine components and reducing the amount of lost product.

The prior art includes various fish canning machines for tuna and other fish. It is known in the prior art to split the incoming tuna into two separate processing lanes, in part to increase the canning speed capacity of the equipment. Such prior art machines are taught in U.S. Pat. Nos. 5,887,414 and 4,116,600.

A significant aspect of the present invention is that the incoming supply of tuna or other fish being fed into the machine is split, not only into two lanes, but is subsequently split into four lanes. The advantage of splitting the infed tuna or other fish into four lanes is to minimize the operational speed of most of the components of the machine. The present invention, in its preferred configuration, uses two turning wheels using a common drive and having a total of eight lanes and is expected to achieve canning speeds of approximately 600 cans per minute, whereas the fastest fish canning machines known to the applicants are capable of speeds of approximately 300 cans per minute.

The prior art fish canning machines, including the two patents noted above, typically package the fish into the can when the can is in a vertical position, i.e., the bottom of the can is oriented vertically. An inherent disadvantage of the prior art vertical alignment is the tendency of chunks of fish to fall out of the vertically oriented can before the top of the can has been applied and sealed. Not only does this result in lost product, but the lost product must be cleaned off the machine and/or the cannery floor.

Another significant aspect of the present invention is that the can filling step is performed while the can is horizontal, i.e., the base of the can is oriented horizontally. This alignment during the can filling step avoids the inherent weakness of the typical prior art canning machines.

The increased capacity provided by the present invention is achieved while simultaneously reducing the incidence of lost product, and is also achieved simultaneously with minimizing the operational speeds of the major components of the machinery.

Accordingly, a primary object of the invention is to provide a solid, chunk and flake fish canning method and apparatus capable of achieving canning speeds of approximately 600 cans per minute.

A further object of the invention is to provide a fish canning apparatus wherein the incoming stream of tuna or other fish is split into four separate processing lanes, in part to minimize the operational speeds of most of the machine components.

Another object of the invention is to provide a fish canning apparatus wherein the packing step occurs when the can is oriented with its bottom in a horizontal plane, thereby minimizing lost product that otherwise tends to occur when the packing step takes place with a vertically oriented can.

A further object of the invention is to provide a high speed fish canning apparatus capable of achieving higher speeds than prior art devices, while simultaneously reducing lost product and simultaneously minimizing the speed of the primary components of the canning apparatus.

Other objects and advantages of the invention will become apparent from the following detailed description and the drawings wherein:

DETAILED DESCRIPTION OF THE DRAWINGS

The following description in the interest of brevity is limited to tuna. The present invention is not limited to use with tuna but may be utilized with other fish. Furthermore, the present invention is capable of packing solid pack, chunk pack and flake fish. FIGS. 1 through 16B illustrate the invention in one configuration, utilizing one turning wheel 40 and two can star wheels 160 and 170 (see FIG. 16A). The preferred form of the invention is shown in FIG. 17 and utilizes two turning wheels arranged symmetrically on opposite sides of a common drive, each turning wheel interacting with two can star wheels, and having a total of eight lanes. The following detailed description is of a single turning wheel working with two can star wheels.

Figure 1:
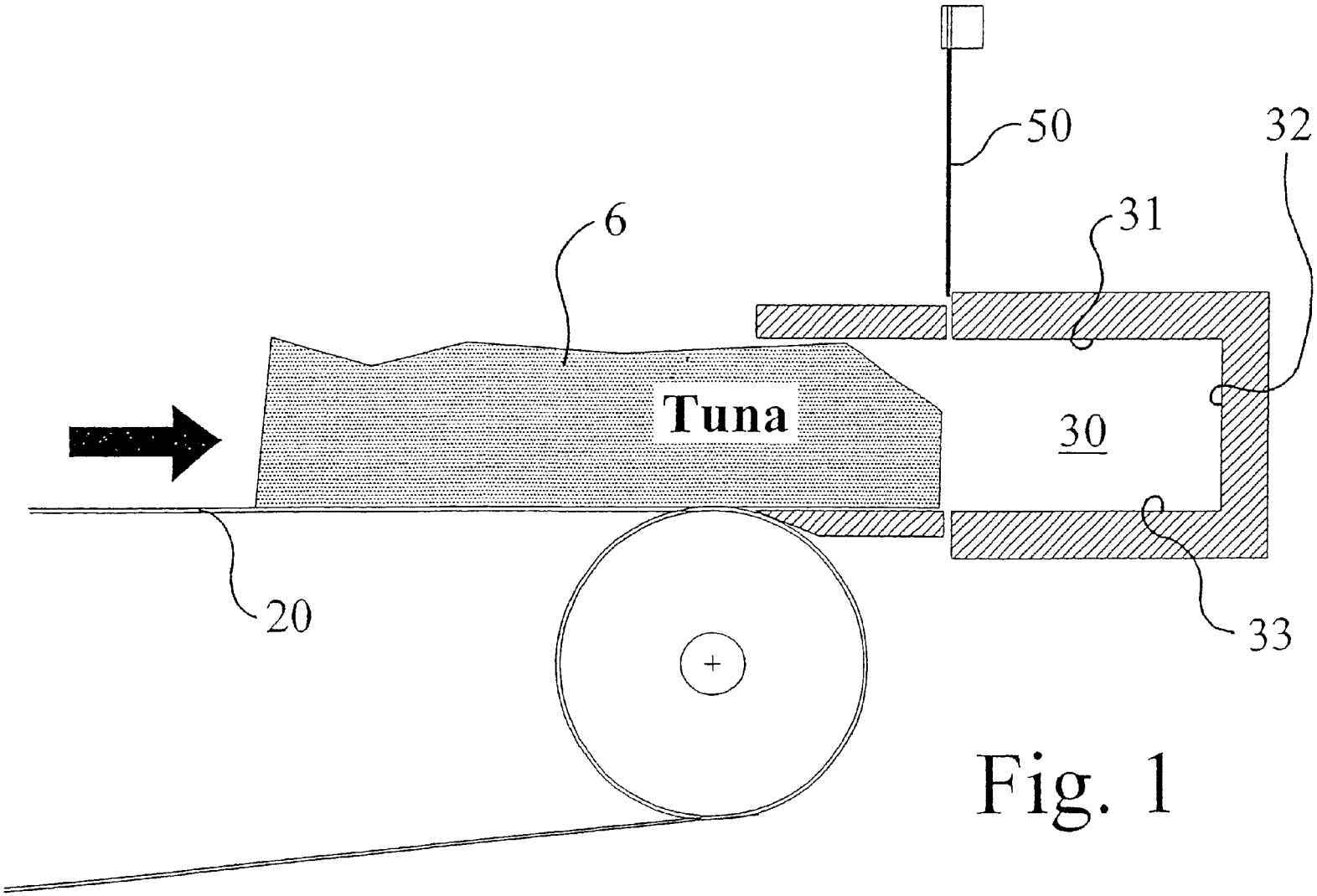
FIG. 1 is a schematic representation showing fish loaded onto an infeed conveyor.

FIG. 1 illustrates an incoming stream of tuna loin 6 moving on infeed conveyor 20 into compression chamber 30 formed by walls 31, 32 and 33. Loin knife 50 is in its uppermost retracted position, allowing the tuna loin to move freely into compression chamber 30.

Figure 2:
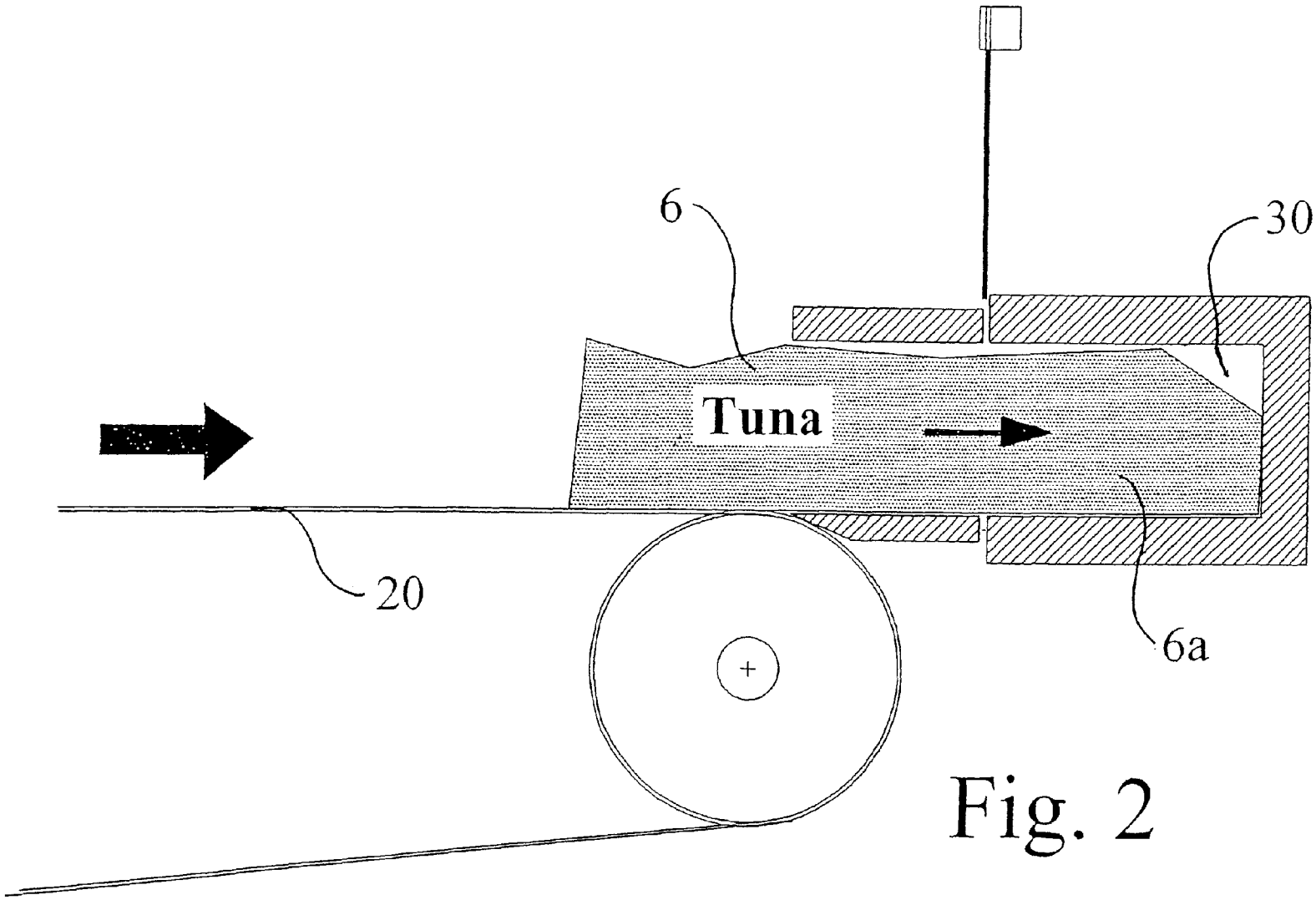
FIG. 2 is a schematic representation showing the fish being conveyed into the compression chamber.

FIG. 2 illustrates the stream of tuna loin 6 moving into compression chamber 30 and shows a predetermined length of conveyed tuna loin 6*a* that has entered the compression chamber 30.

Figure 3:
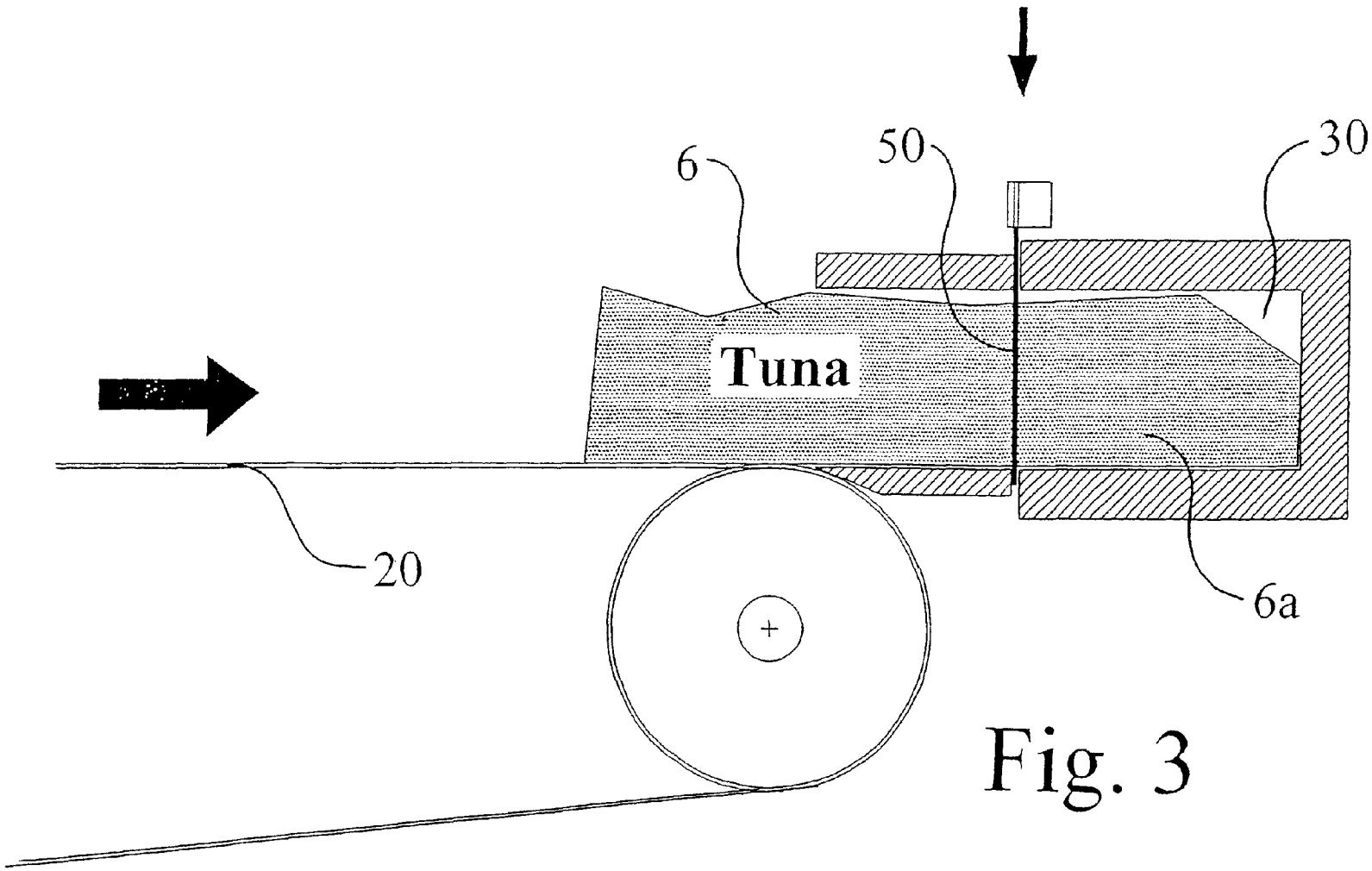
FIG. 3 is a schematic representation showing a predetermined length of conveyed fish in the compression chamber being severed by a loin knife.

FIG. 3 illustrates the depression of loin knife 50 to sever a predetermined length 6*a* of conveyed tuna loin 6 in compression chamber 30.

Figure 4:
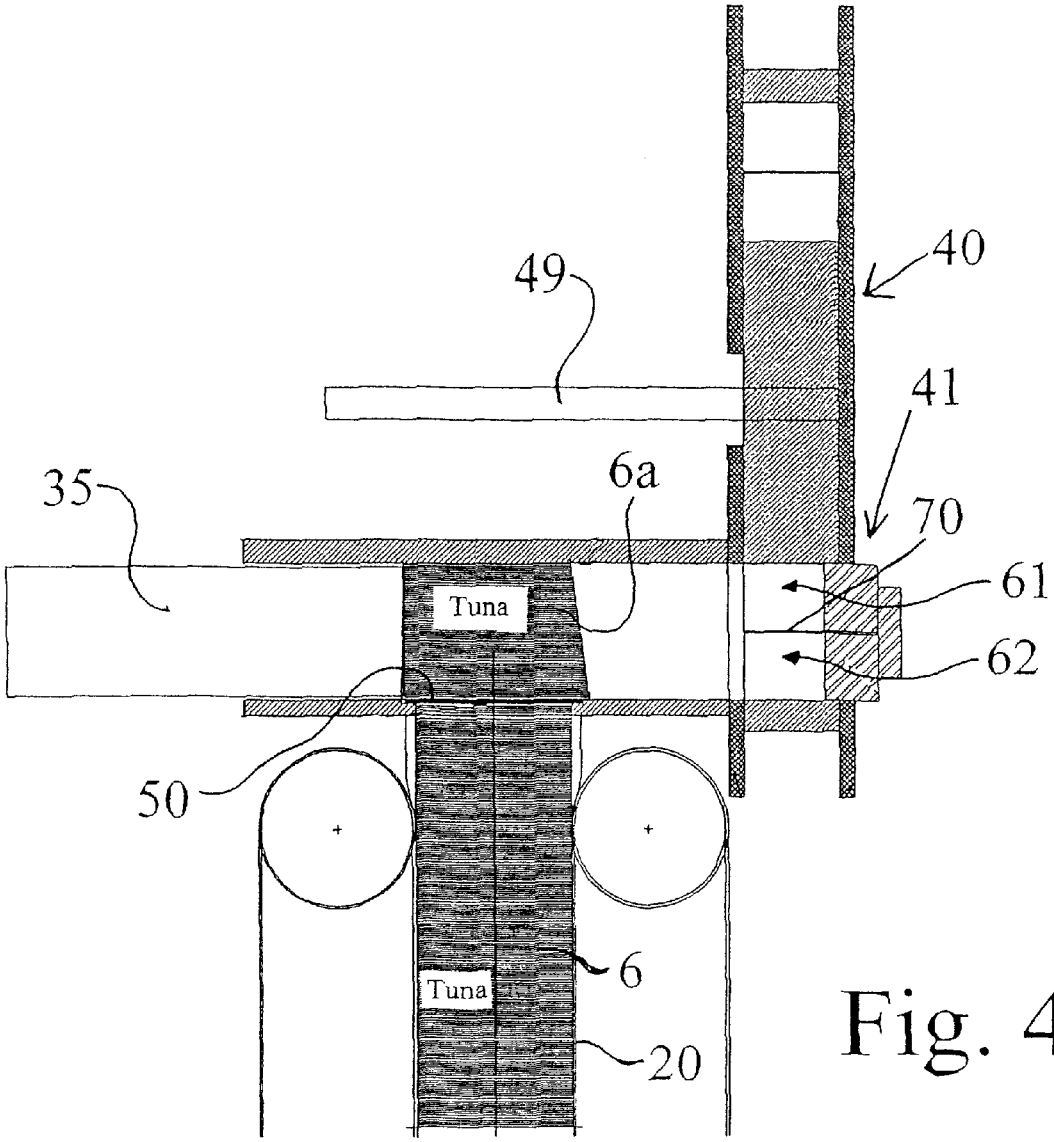
FIG. 4 is a top view of the apparatus, partially in section, as the predetermined length of fish is being severed in the compression chamber by the loin knife.

FIG. 4 is a top view, partially in section, showing infeed conveyor 20, loin knife 50 and the severed portion of tuna 6*a* in compression chamber 30. Compression chamber 30 is adjacent a first work station 41 of turning wheel 40. Turning wheel 40 rotates about shaft 49. FIG. 4 illustrates the predetermined length of conveyed tuna 6*a* before it is compressed by piston 35 into first and second forming chambers 61 and 62.

Figure 5:
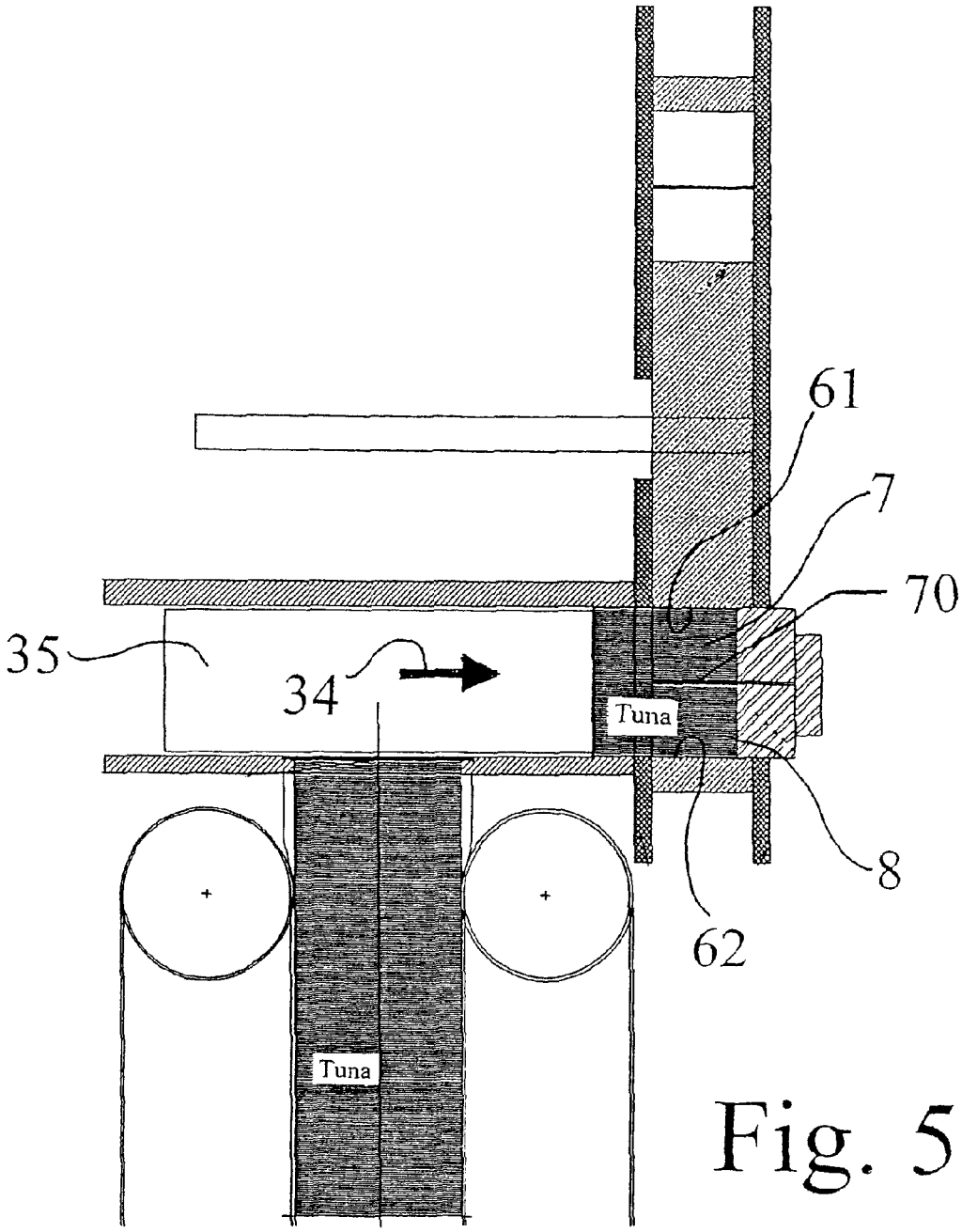
FIG. 5 is a top view of the apparatus shown in FIG. 4 showing the fish being forced under pressure through the first dividing knife into the first and second forming chambers.

FIG. 5 is the same top view as FIG. 4 showing piston 35 as it moves to the right, in the direction of arrow 34, and compresses the tuna into forming chambers 61 and 62. As the tuna portion 6*a* is compressively driven into chambers 61 and 62, it is forced across a first dividing knife means 70 into two separate portions 7 and 8. Dividing knife means 70 is a stationary blade and also forms a wall between forming chambers 61 and 62. In the preferred embodiment, the forming chambers 61 and 62 are of equal volume and identical shape.

Figure 6:
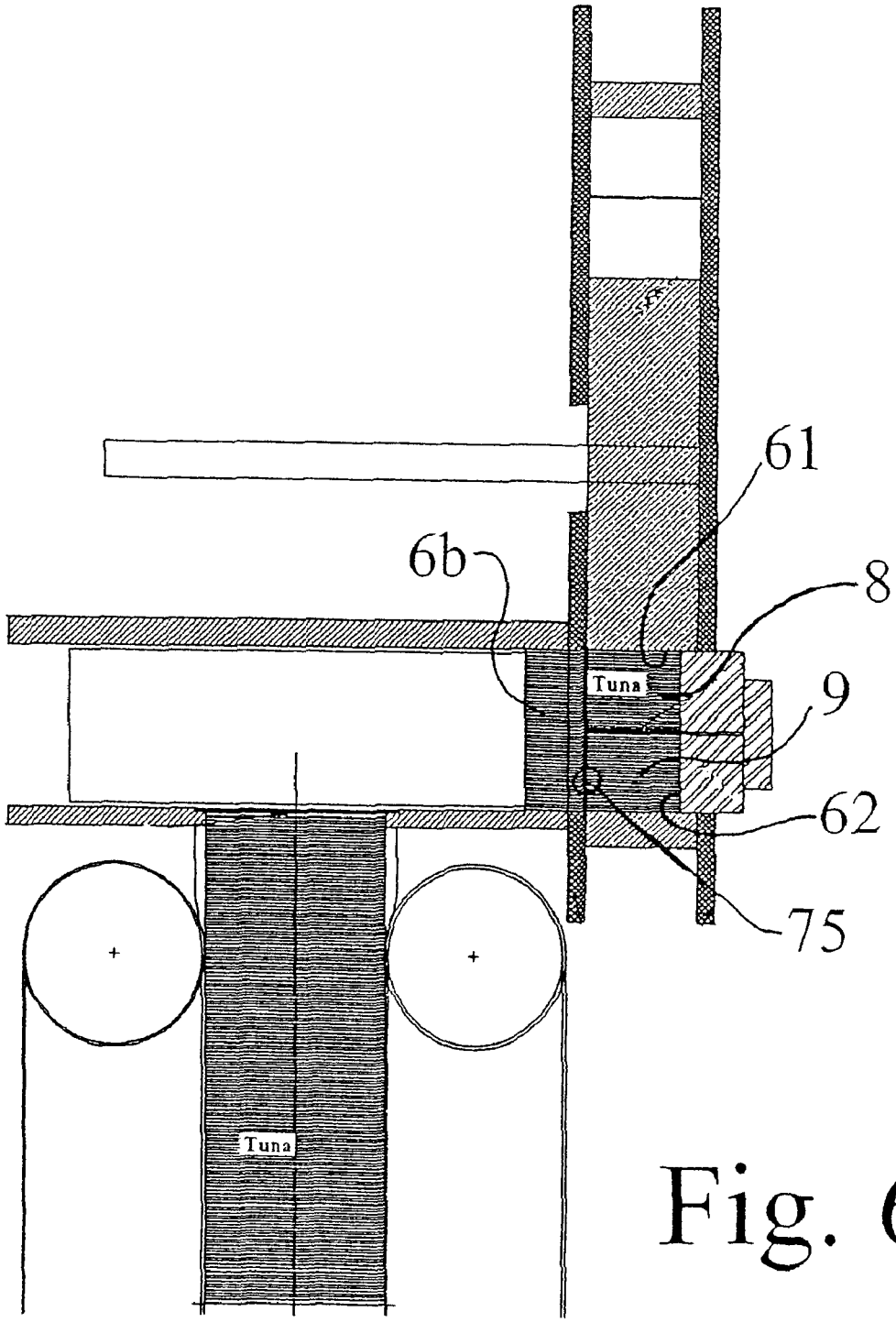
FIG. 6 is a top view of the apparatus shown in FIGS. 4 and 5 wherein a metering knife has severed the compressed fish in the two forming chambers into two compressed fish blocks.

FIG. 6 illustrates how metering knife means 75 severs the compressed tuna in forming chambers 61 and 62 to form first and second compressed fish blocks 8 and 9. The excess tuna is shown as portion 6*b* and becomes utilized in the next cycle of the apparatus.

Figure 7:
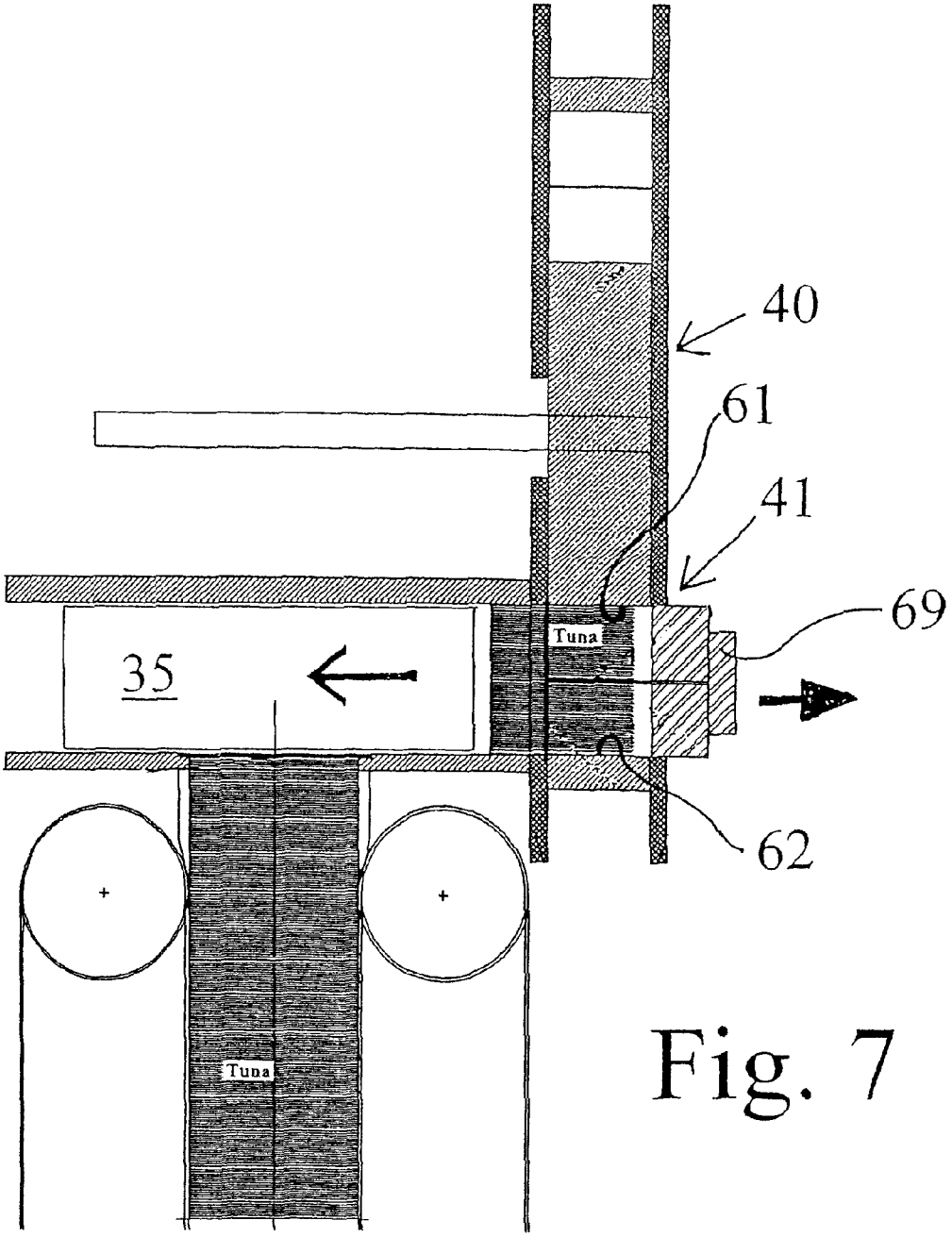
FIG. 7 is a top view of the apparatus shown in FIGS. 4–6 wherein the metering plug has been retracted, allowing the turning wheel to rotate.

FIG. 7 illustrates the next step in which the metering plug 69 is retracted, to allow the turning wheel 40 to rotate. Metering plug 69 forms an end wall of forming chambers 61,62 and is adjustable in order to vary the volume of forming chambers 61 and 62 to assure proper net weight of fish ultimately packed in the cans. Compression piston 35 is retracted in this step.

Figure 8:
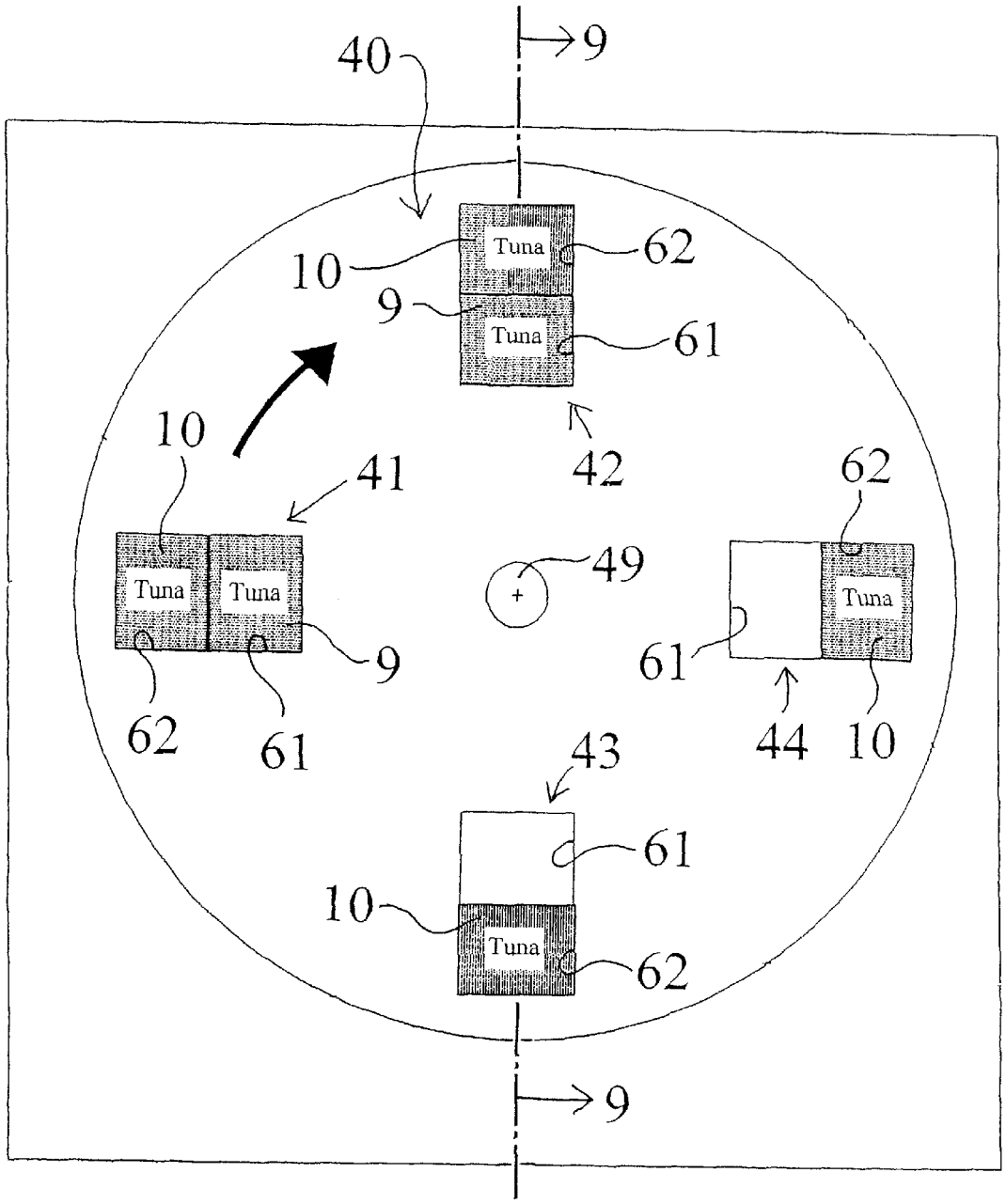
FIG. 8 is a schematic representation showing how the turning wheel rotates to move the first and second forming chambers with the compressed fish blocks therein from the first work station to the second and third work stations.

FIG. 8 is a schematic representation showing turning wheel 40 and shaft 49 (FIGS. 8 and 9) about which turning wheel 40 rotates. In the embodiment illustrated in FIG. 8, turning wheel 40 has a first work station 41 which is adjacent the incoming feed conveyor illustrated in FIGS. 1–3. Second work station 42 is positioned 90° clockwise from first station 41. Third work station 43 is positioned 180° from second station 42 and second and third stations are positioned at the top and bottom of wheel 40, respectively, in order to facilitate orienting of the cans in a horizontal position. A fourth station 44 is provided which is simply an idle position. FIG. 8 illustrates the step in which the compressed fish blocks 9 and 10 in forming chambers 61 and 62 are rotated to the second work station 42 for purposes described in detail below. FIG. 8 also illustrates the cycle of operation of turning wheel 40. Fish block 9 is transferred out of forming chamber 61 at the second work station 42. At the same time, fish block 10 (from an earlier cycle) is being transferred out of forming chamber 62 at third work station 43. Forming chambers 61 and 62 are both empty when they are rotated back to first work station 41. Third work station 43 is an idle position with forming chamber 61 empty and forming chamber 62 containing fish block 10.

Figure 9:
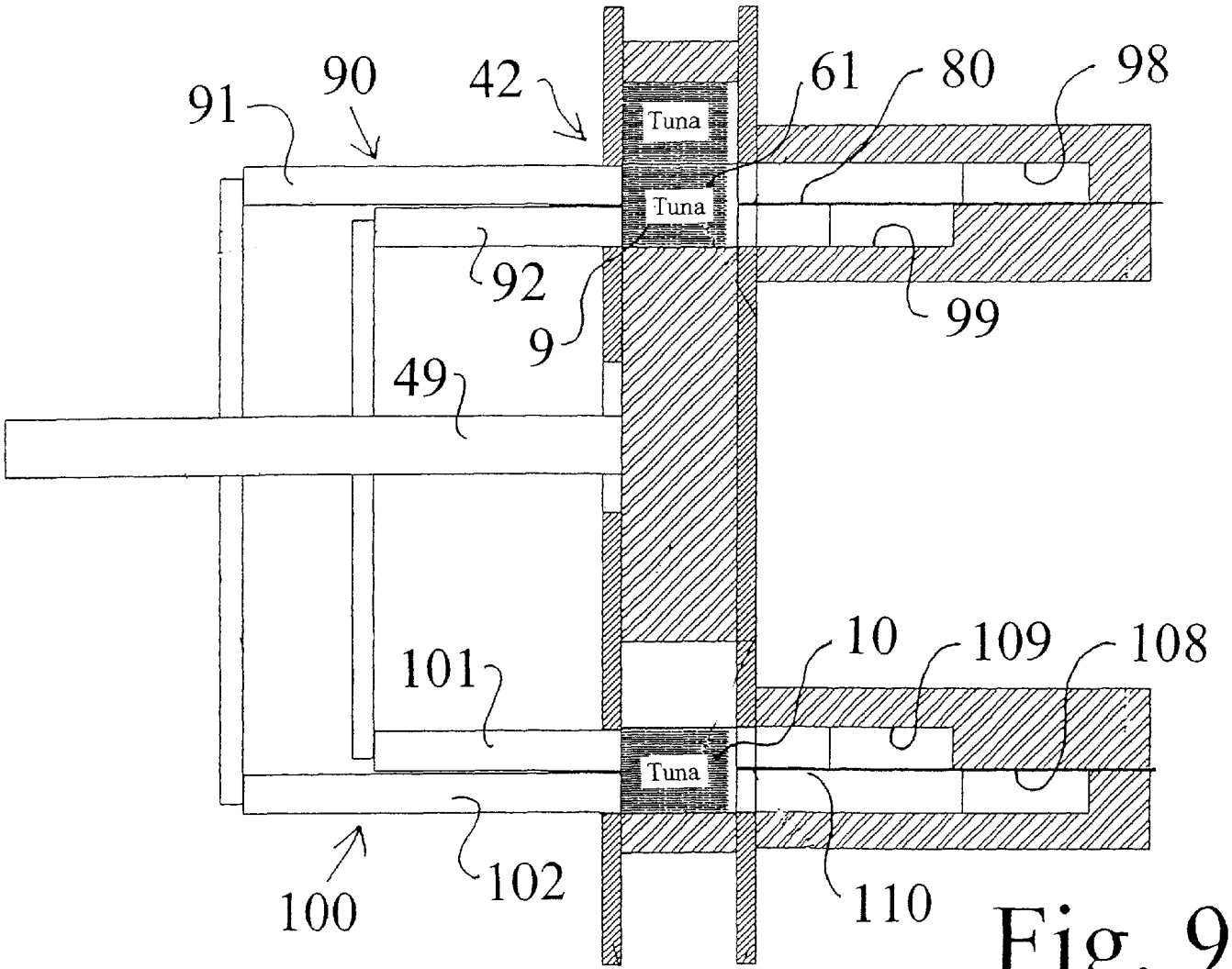
FIG. 9 is a sectional view on the lines 9—9 of FIG. 8.

FIG. 9 illustrates a cross-sectional view on the line 9—9 of FIG. 8 and illustrates the positioning of first transfer means 90 at said second work station 42. Transfer pistons 91 and 92 are utilized to forcibly drive the first compressed fish block 9 from chamber 61 across a second dividing knife means 80 into formats 98 and 99.

Similarly, FIG. 9 illustrates second transfer means 100 including transfer pistons 101 and 102 that are utilized to drive the second compressed fish block 10 into formats 108 and 109. Compressed fish block 10 is driven by transfer pistons 101 and 102 through a third dividing knife means 110 to form can-sized cakes that are transferred into format chambers 108 and 109.

Figure 10:
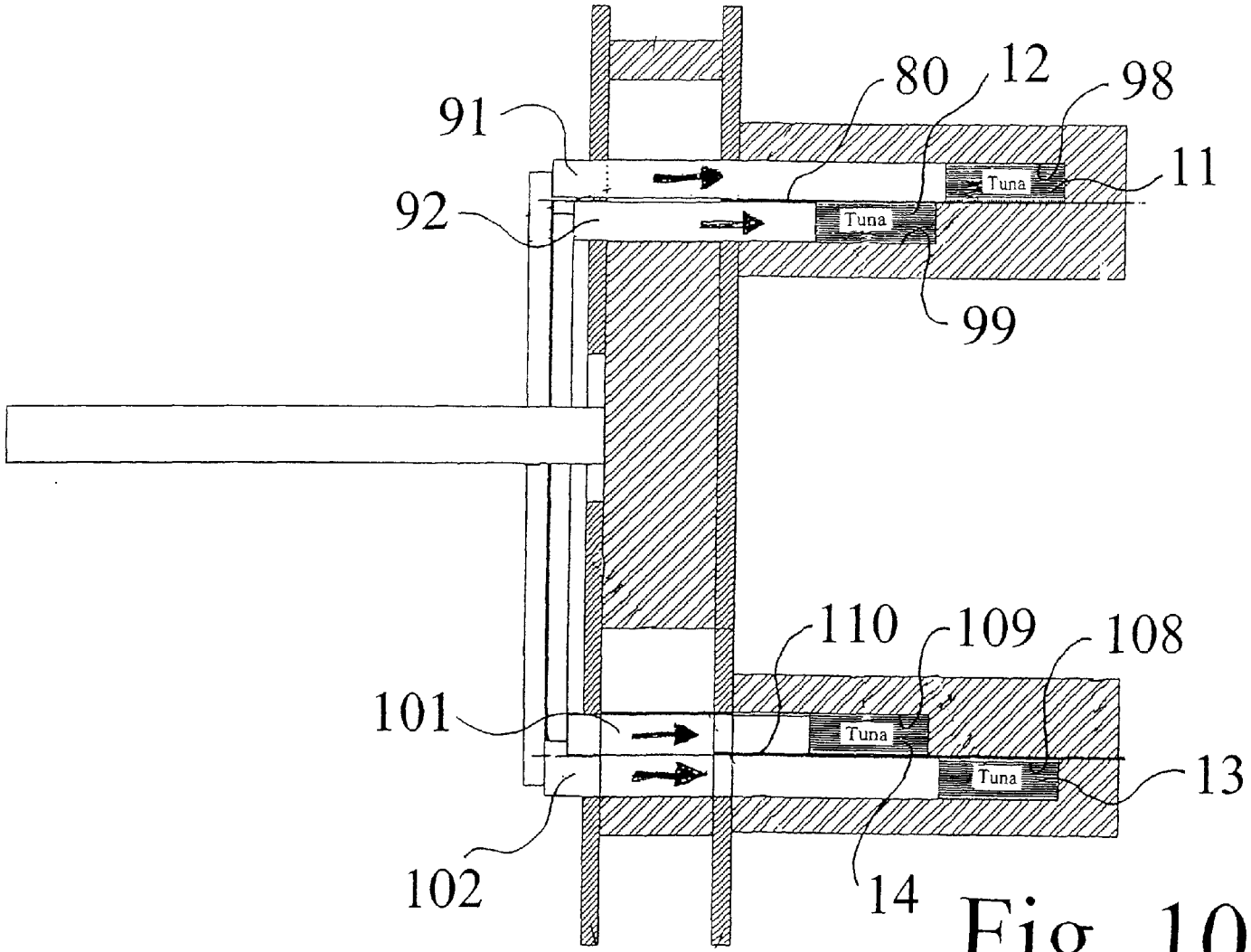
FIG. 10 is the same sectional view as FIG. 9 showing how the transfer pistons at the second and third work stations transfer the compressed fish blocks out of the forming chambers and across second and third dividing knives to form four fish blocks.

FIG. 10 illustrates schematically the operation of transfer pistons 91,92 and 101,102 to transfer the fish blocks 9 and 10 across dividing knives 80 and 110 and into formats 98,99 and 108,109. As shown in FIG. 10, a first pair of can-sized tuna blocks 11 and 12 have been transferred into formats 98,99 and are positioned to be formed into circular cakes and packaged into horizontally oriented cans, as described below. Similarly, a second pair of can-sized tuna blocks 13 and 14 has been positioned adjacent the third work station 43 to be formed into circular cakes and packaged into horizontally oriented cans.

Figure 11B:
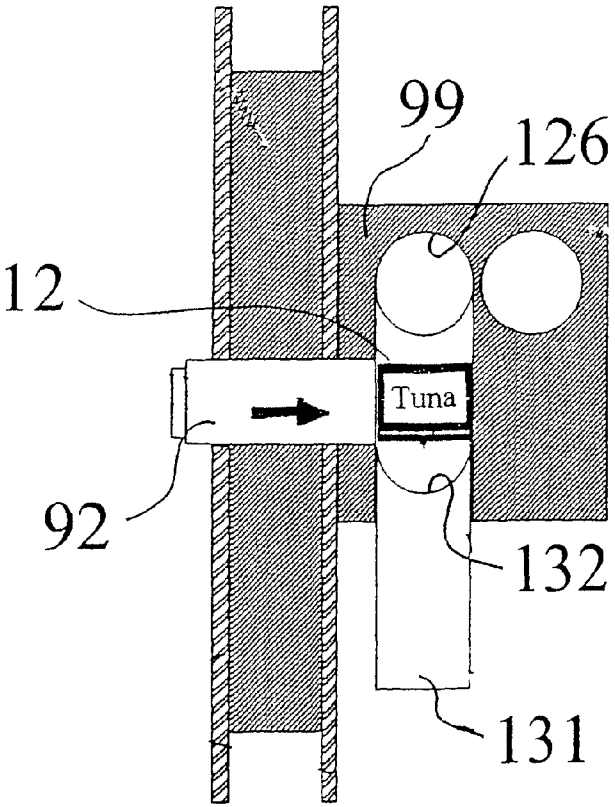
FIGS. 11A and 11B are top views, partially in section, showing the second and third work stations, respectively.
Figure 11A:
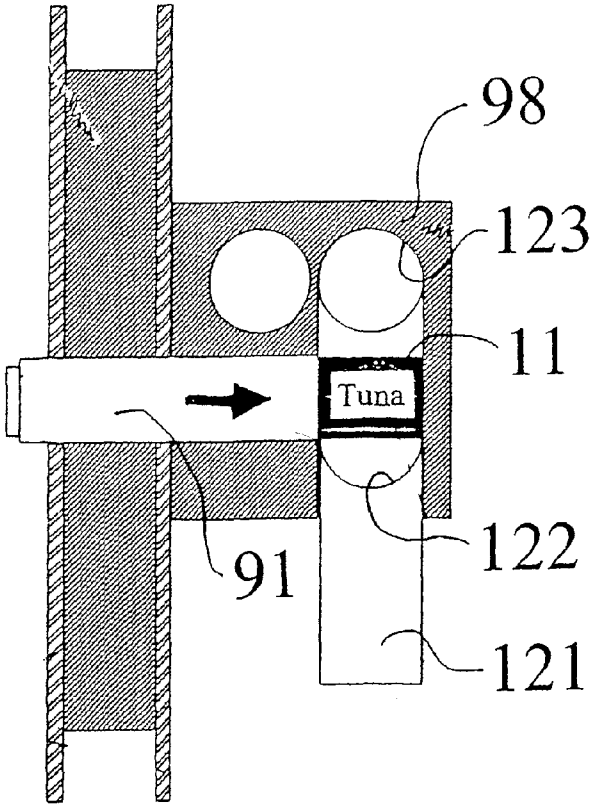

FIGS. 11A,B and 12A,B are sectional views illustrating the forming of can-sized tuna blocks 11 and 12 into rounded tuna cakes 11*a* and 12*a* capable of being inserted into a conventional can.

Figure 12B:
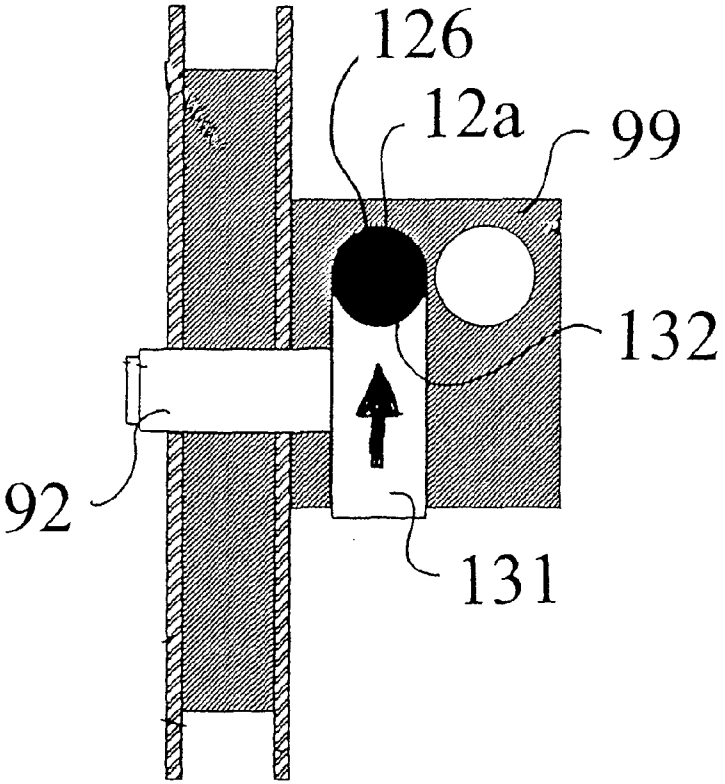
FIGS. 12A and 12B are the same views as 11A, 11B and show how forming shoes are utilized to form the four compressed fish blocks into four round can-sized cakes for insertion into horizontally positioned cans.
Figure 12A:
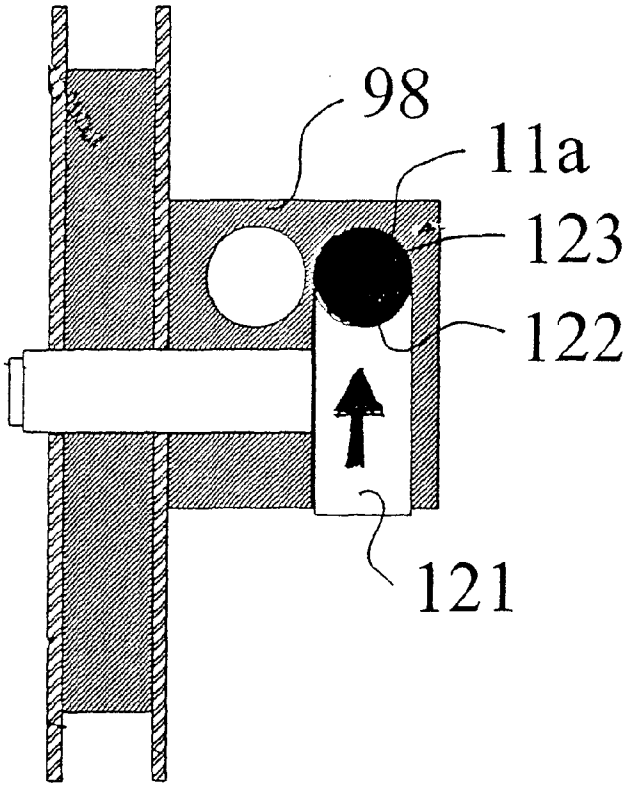

As shown in FIG. 11A, transfer piston 91 (with transfer piston 92) has driven tuna block 9 across second dividing knife 80 and split tuna block 9 into can-sized blocks 11 and 12. Piston 91 drives tuna block 11 into format 98. As shown in FIGS. 11A and 12A, forming shoe 121 slidably moves in format 98 between its retracted position in FIG. 11A and its advanced position shown in FIG. 12A. As shown in FIG. 12A, forming shoe 121 is advanced and its rounded leading surface 122 forms a rounded, can-sized tuna cake 11*a* in the rounded recess 123 of format 98. As shown in FIG. 11B, transfer piston 92 moves simultaneously with transfer piston 91 to drive tuna block 9 (see FIG. 9) across second dividing knife 80 (see FIG. 9) and transfer piston 92 drives tuna block 12 into format 99. Forming shoe 131 slidably moves in format 99 between its retracted position shown in FIG. 11B and its advanced position shown in FIG. 12B, wherein its leading rounded surface 132 forms a rounded, can-sized tuna cake 12*a*. Format 99 has a rounded recess 126 which works with rounded surface 132 to produce cake 12*a*. FIGS. 11A,B and 12A,B show the transfer of tuna block 9 into can-sized blocks 11,12 at second work station 42. Simultaneously, at third work station 43, as shown in FIGS. 9 and 10, tuna block 10 is being split by knife 110 into can-sized blocks 13,14 and driven into formats 108,109 in identical fashion.

Figure 13:
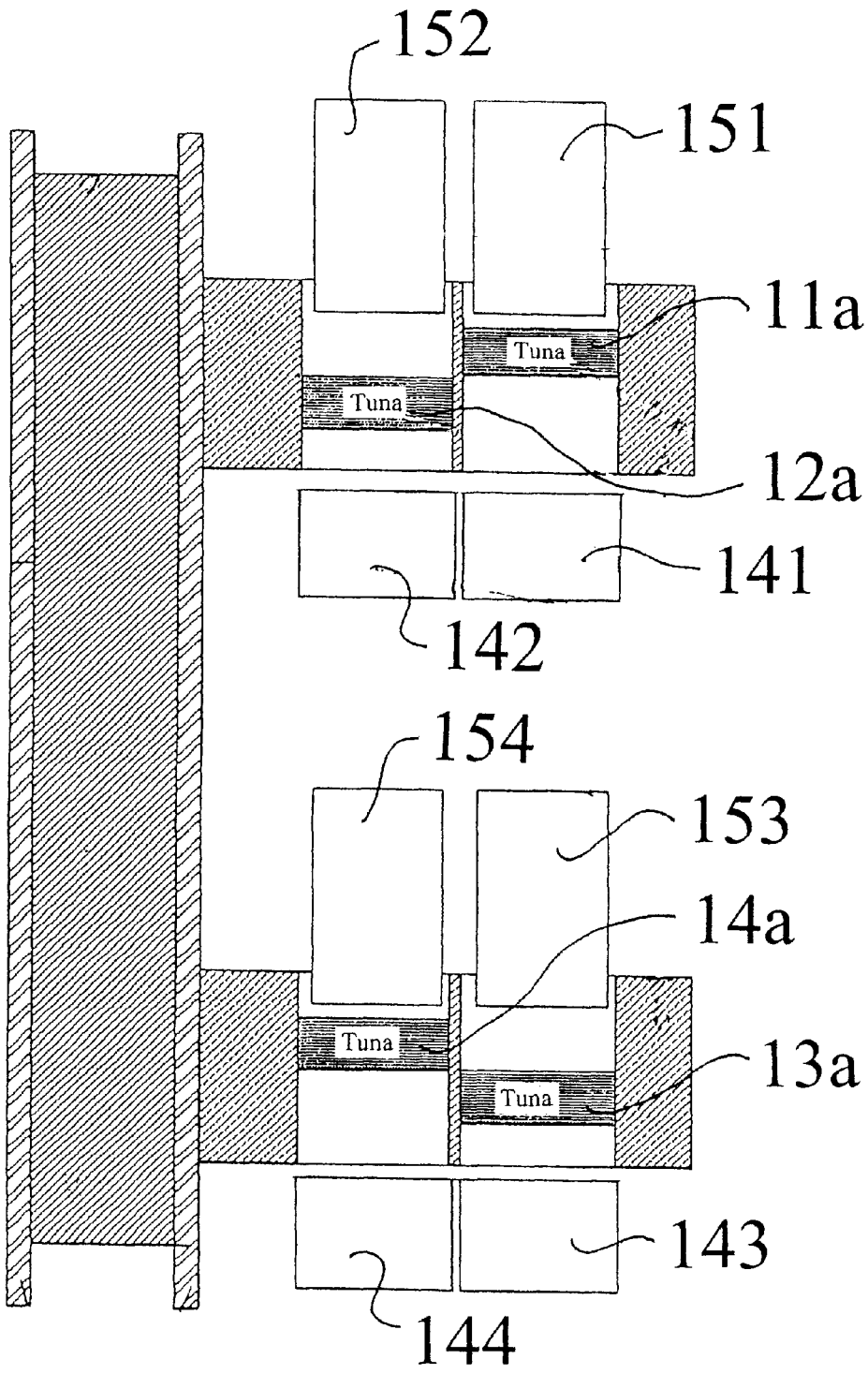
FIG. 13 is a schematic representation showing the four can-sized rounded tuna cakes about to be inserted into horizontally oriented cans by discharge pistons.
Figure 14:
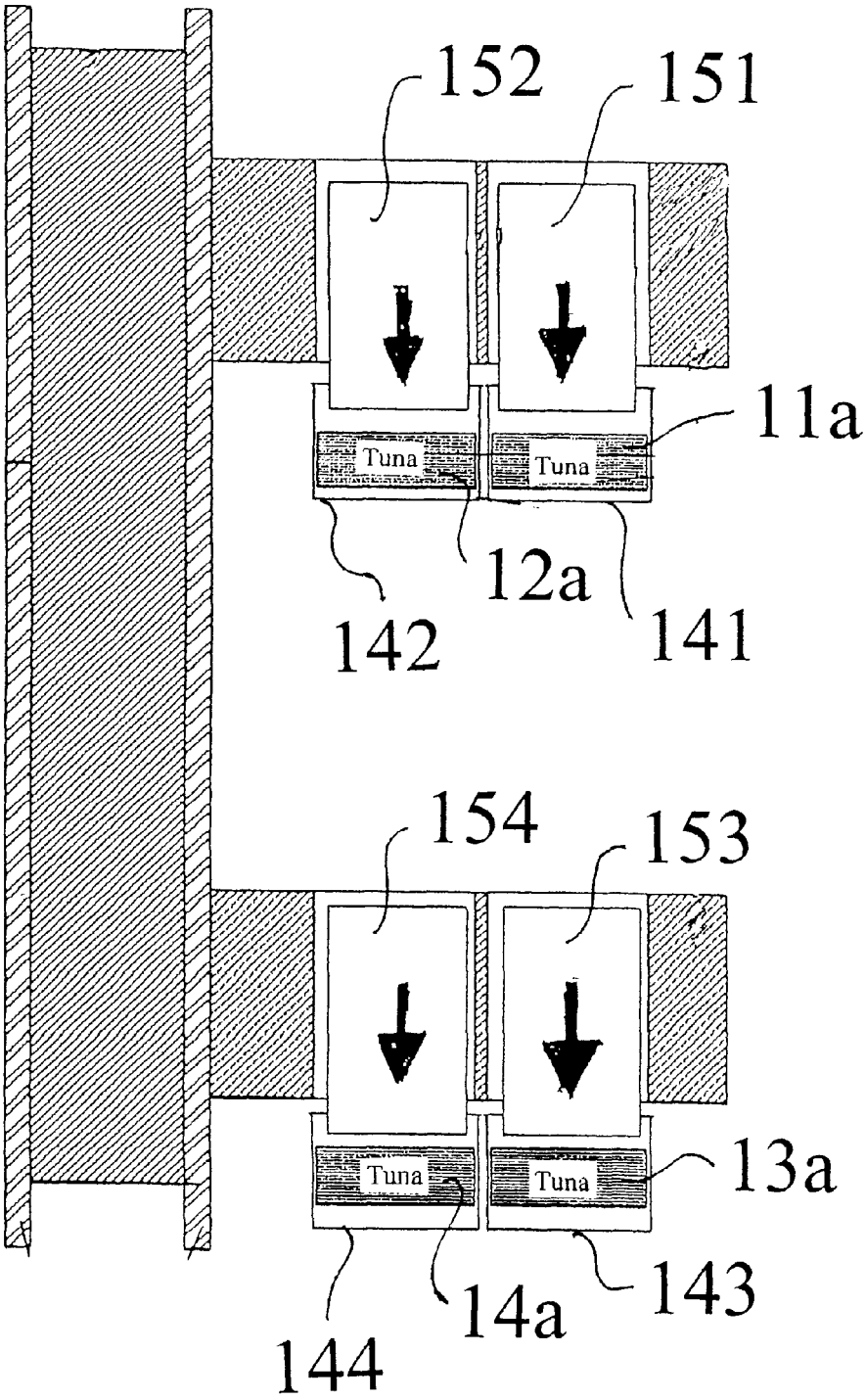
FIG. 14 is a schematic representation showing the four rounded tuna cakes fully inserted into four horizontally oriented cans by discharge pistons.

FIGS. 13 and 14 show the simultaneous discharge of four rounded, can-sized tuna cakes 11*a*,12*a*,13*a* and 14*a* downwardly into horizontally oriented cans 141–144, respectively, by the downward motion of discharge pistons 151–154, respectively. FIG. 13 shows discharge pistons 151–154 in their uppermost, retracted positions. FIG. 14 shows discharge pistons 151–154 in their downward, advanced positions in which each of the four rounded tuna cakes 11*a*–14*a* is driven downwardly into horizontally oriented cans 141–144.

Figure 15:
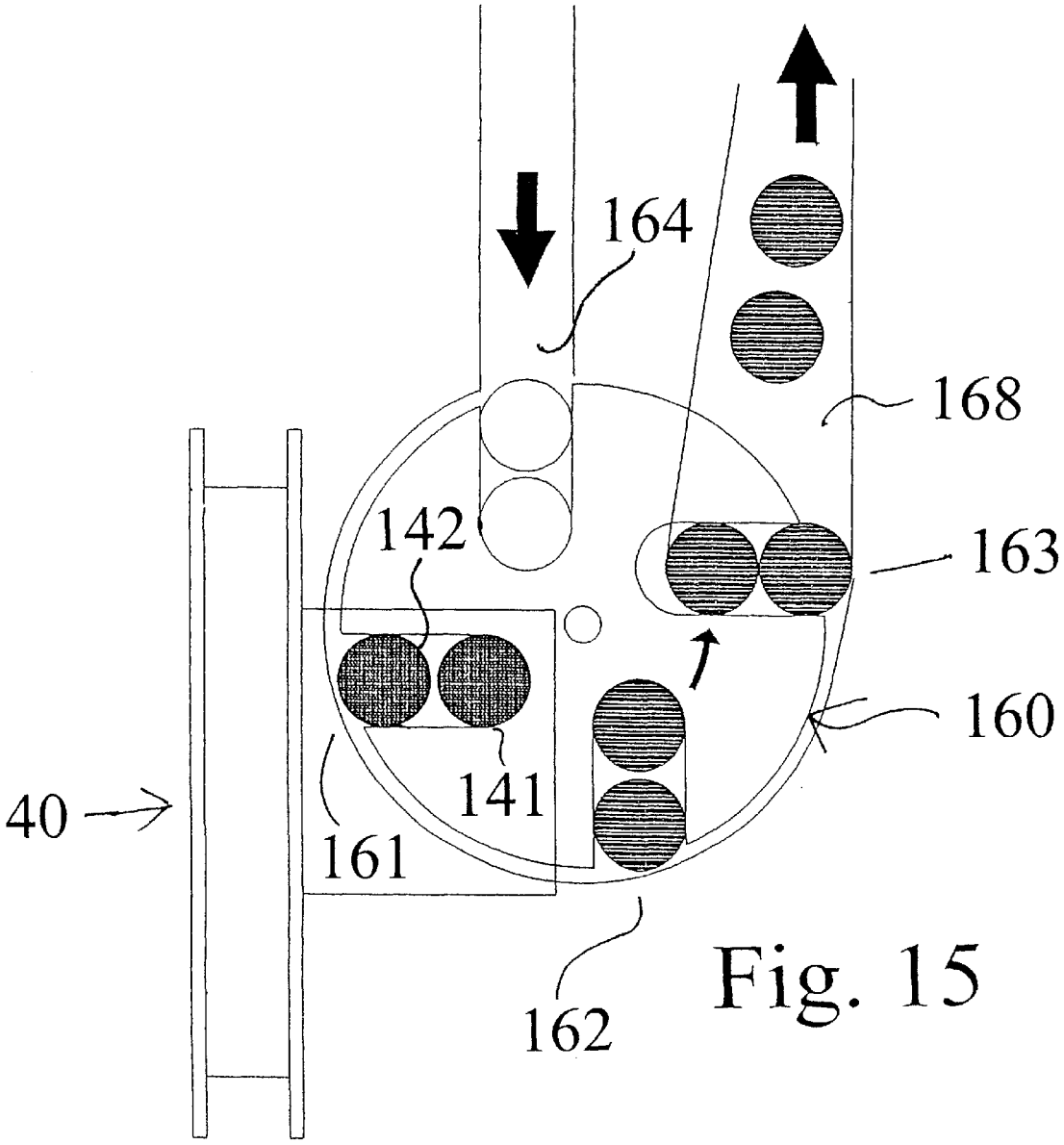
FIG. 15 is a schematic representation showing operation of a can star wheel relative to the operation of the turning wheel.

FIG. 15 illustrates the operation of upper can star wheel 160 relative to turning wheel 40. Cans 141,142 have been filled with tuna cakes 11*a*, 12*a* as described above. Star wheel 160 has an intermittent 90° motion with four work stations 161–164. Cans are filled at first work station 161. Second work station 162 is an idle position. Third work station 163 is a discharge station where the filled cans enter discharge chute 168. The fourth work station 164 feeds empty cans into star wheel 160. An identical star wheel 170 is provided to service the third work station 43 of turning wheel 40 and star wheel 170 is not described in detail in the interest of brevity.

Figure 16A:
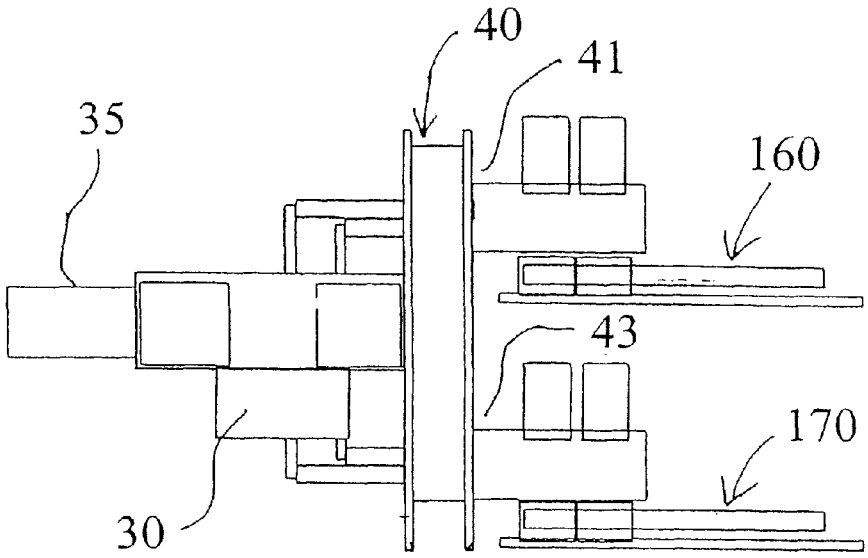
FIGS. 16A and 16B are schematics showing side elevational and front elevational views of the infeed assembly, turning wheel and two can star wheel assemblies.
Figure 16B:
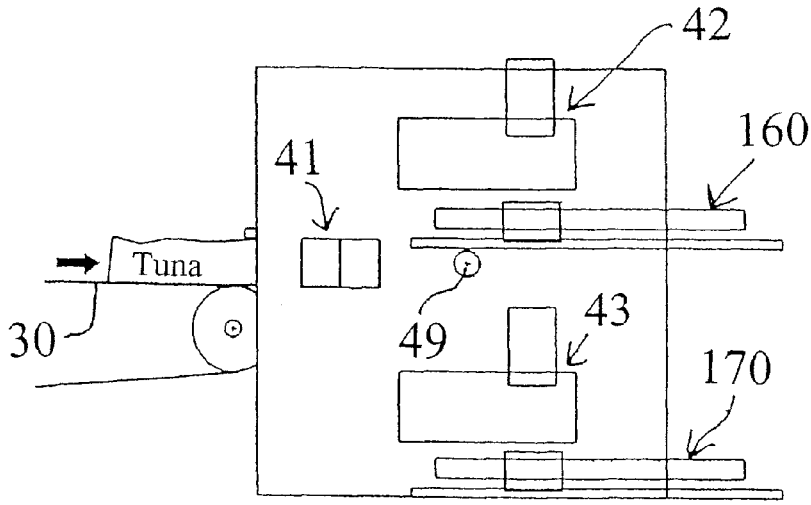
Figure 17:
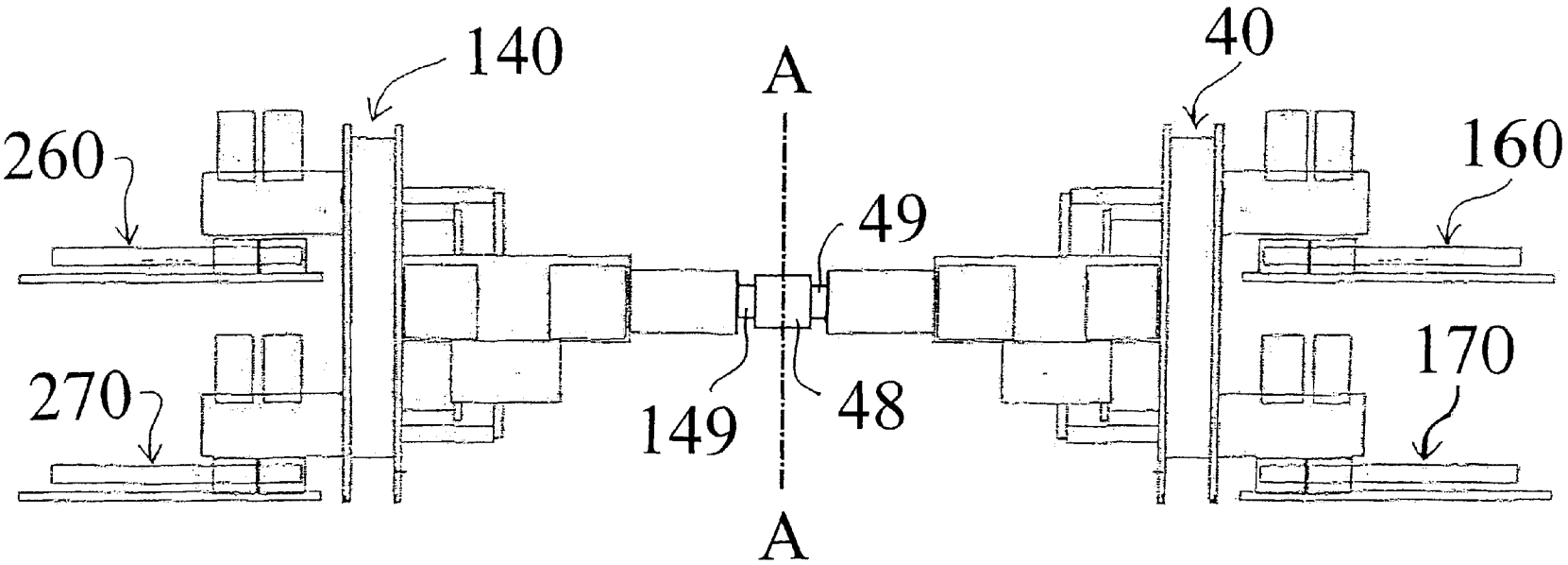
FIG. 17 is a schematic representation of the preferred form of the invention, wherein two turning wheels are actuated by a common drive; four can star wheels are utilized so that eight cans are packed simultaneously.

FIGS. 16A–16B show the overall relationship between the infeed conveyor 30, single turning wheel 40 and can star wheels 160 and 170.

The present invention, as shown in the single turning wheel configuration of FIGS. 1–16B, uses a series of three dividing knives located at three separate work stations of the intermittently rotating turning wheel rotating about a horizontal axis to form four streams or channels of rounded, can-sized fish cakes. Positioning the second and third dividing knives at work stations located at the top and bottom of the turning wheel facilitates discharging the formed cakes into horizontally oriented cans. The horizontally oriented cans are delivered to the vertically separated turning wheel work stations by can star wheels which rotate about vertical axes and which are spaced apart vertically. The motion of the can star wheels is synchronized with the turning wheel. The vertical spacing of the turning wheel work stations is great enough to allow vertically oriented discharge pistons to drive the fish cakes downwardly into the cans.

The preferred embodiment of the invention is shown in FIG. 17. This embodiment utilizes two turning wheels 40 and 140, positioned symmetrically on opposite sides of central axis A—A. Drive shaft 49 actuates turning wheel 40 and drive shaft 149 actuates turning wheel 140. Drive shafts 49 and 149 are synchronized by gear box 48. A single drive can therefore be used to actuate turning wheels 40 and 140 simultaneously. The single drive can also be used to actuate the can star wheels synchronously with the turning wheels. Turning wheel 140 cooperates with can star wheels 260 and 270 in the same fashion that turning wheel 40 cooperates with can star wheels 160 and 170. This configuration of dual turning wheels having a common drive uses a total of eight lanes and is capable of speeds of 600 cans per minute. Since turning wheel 140 and all its related components is identical to turning wheel 40, a detailed description of turning wheel 140 and its related components is not repeated in the interest of brevity. Since can star wheels 260 and 270 are identical with wheels 160 and 170, a detailed description is likewise not repeated.

Figure 18:
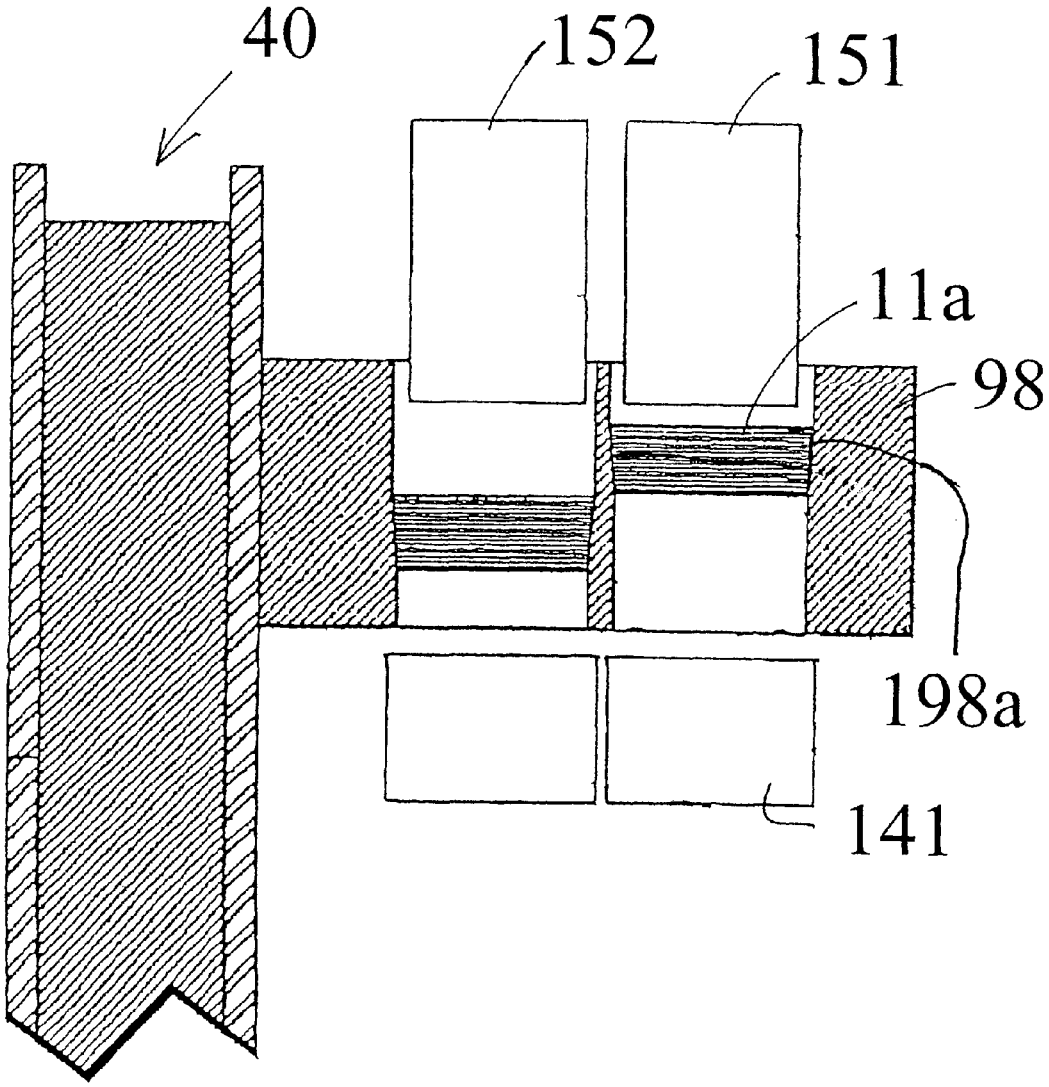
FIG. 18 is a schematic representation showing four can-sized rounded tuna cakes about to be discharged into cans wherein a tapered bore is utilized to support the tuna cakes.

FIG. 18 illustrates an alternate form of the invention wherein the format 98 has a tapered discharge bore 198*a* to help support the temporarily suspended tuna cake 11*a* before being discharged into can 141. All discharge bores in the various formats would be so tapered in this embodiment.

The foregoing description of the invention has been presented for purposes of illustration and description and is not intended to be exhaustive or to limit the invention to the precise form disclosed. Modifications and variations are possible in light of the above teaching. The embodiments were chosen and described to best explain the principles of the invention and its practical application to thereby enable others skilled in the art to best use the invention in various embodiments and with various modifications suited to the particular use contemplated. The scope of the invention is to be defined by the following claims.

What is claimed is:

1. A method for automatically packaging fish at high speed into horizontally oriented cans, comprising the steps:

feeding a predetermined amount of fish into first and second forming chambers, and dividing said predetermined amount of fish into two separate quantities as said fish is fed into said first and second forming chambers, said first and second forming chambers being positioned at a first work station, compressing said fish in said first and second forming chambers, and severing said compressed fish in said chambers to produce first and second compressed fish blocks in said forming chambers, moving said first and second forming chambers with said first compressed fish block therein to a second work station, transferring said first compressed fish block out of said first forming chamber at said second work station, through a dividing knife and forming a first pair of two can-sized cakes, discharging said first pair of can-sized cakes into two, horizontally oriented cans, moving said first and second forming chambers with said second compressed fish block therein to a third work station, transferring said second compressed fish block out of said second forming chamber at said third work station, through a dividing knife and forming a second pair of two can-sized cakes, and discharging said second pair of can-sized cakes into two, horizontally oriented cans.

2. The method of claim 1 further comprising the preliminary steps:

conveying an incoming stream of fish into a compression chamber, and severing a predetermined length of said conveyed fish in said compression chamber.

3. The method of claim 1 comprising the further step:

moving said first and second forming chambers between said first, second and third work stations with a turning wheel.

4. The method of claim 3 wherein said turning wheel also moves to a fourth, idle position, and wherein said second and third work stations are separated by 180° relative to said turning wheel.

5. The method of claim 4 wherein said first and second pairs of can-sized cakes are simultaneously discharged into a total of four horizontally oriented cans.

6. The method of claim 5 comprising the further steps:

supplying empty, horizontally oriented cans to said second and third work stations with rotating can star wheels, said can star wheels each having four work stations, removing filled, horizontally oriented cans from said second and third work stations by said can star wheels.

7. Apparatus for automatically packaging fish at high speed into horizontally oriented cans, comprising:

a turning wheel having a first, second and third work stations, first and second forming chambers carried by said turning wheel, first dividing knife means positioned adjacent said first and second forming chambers, means for driving a first predetermined amount of fish under pressure through said first dividing knife means into first and second forming chambers at said first work station, metering knife means for severing said fish under pressure in said first and second forming chambers to produce first and second compressed fish blocks, means for moving said first and second forming chambers between said first, second and third work stations, second dividing knife means at said second working station, first transfer means positioned at said second working station for pushing said first compressed fish block out of said first forming chamber and through said second dividing knife means to form a first pair of can-sized cakes, means for discharging said first pair of can-sized cakes downwardly into horizontally oriented cans, third dividing knife means at said third working station, second transfer means positioned at said third working station for pushing said second compressed fish block out of said second forming chamber and through said third dividing knife means to form a second pair of can-sized cakes, and means for discharging said second pair of can-sized cakes downwardly into horizontally oriented cans.

8. The apparatus of claim 7 wherein said turning wheel has four work stations spaced at 90° intervals.

9. The apparatus of claim 8 wherein said second and third work stations are positioned at the top and bottom of said turning wheel, respectively.

10. The apparatus of claim 9 further comprising can star wheel means adjacent said second and third work stations of said turning wheel for supplying empty cans to be filled and for removing filled cans.

11. The apparatus of claim 10 wherein said can star wheel means comprises four work stations and said can star wheel means moves intermittently between said four work stations.

12. Apparatus for automatically packaging fish at high speed into horizontally oriented cans, comprising:

a turning wheel having first, second and third work stations, a compression chamber adjacent said first work station, conveyor means for supplying fish into said compression chamber, loin knife means for severing a first predetermined length of said conveyed fish in said compression chamber, first and second forming chambers carried by said turning wheel, first dividing knife means positioned adjacent said first and second forming chambers for splitting said fish into two portions, piston means carried in said compression chamber for driving said first predetermined length of fish under pressure through said first dividing knife means into first and second forming chambers at said first work station, metering knife means for severing said fish under pressure in said first and second forming chambers to produce first and second compressed fish blocks, means for moving said first and second forming chambers between said first, second and third work stations, first transfer means positioned at said second working station for pushing said first compressed fish block out of said first forming chamber, second dividing knife means and forming shoe means at said second working station for dividing said first compressed fish block and forming a first pair of can-sized cakes, means for packing said first pair of can-sized cakes downwardly into horizontally oriented cans, second transfer means positioned at said third working station for pushing said second compressed fish block out of said second forming chamber, third dividing knife means and forming shoe means at said third working station for dividing said second compressed fish block and forming a second pair of can-sized cakes, and means for packing said second pair of can-sized cakes downwardly into horizontally oriented cans.

13. The apparatus of claim 12 wherein said turning wheel has four work stations spaced at 90° intervals.

14. The apparatus of claim 13 wherein said second and third work stations are positioned at the top and bottom of said turning wheel, respectively.

15. The apparatus of claim 14 further comprising can star wheel means adjacent said second and third work stations of said turning wheel for supplying empty cans to be filled and for removing filled cans.

16. The apparatus of claim 15 wherein said can star wheel means comprises four work stations and said can star wheel means moves intermittently between said four work stations.

17. Apparatus for automatically packaging fish at high speed into horizontally oriented cans, comprising:

first and second turning wheels each having first, second and third work stations, a compression chamber adjacent said first work station of each of said first and second turning wheels, conveyor means for supplying fish into each of said compression chambers, loin knife means for severing a first predetermined length of said conveyed fish in each of said compression chambers, first and second forming chambers carried by each said turning wheel, first dividing knife means positioned adjacent said first and second forming chambers carried by each turning wheel for splitting said fish into two portions, piston means carried in each said compression chamber for driving said first predetermined length of fish under pressure through said first dividing knife means into first and second forming chambers at said first work station of both turning wheels, metering knife means for severing said fish under pressure in said first and second forming chambers carried by each turning wheel to produce first and second compressed fish blocks, means for moving said first and second forming chambers carried by each turning wheel between said first, second and third work stations, first transfer means positioned at said second working station of each turning wheel for pushing said first compressed fish block out of said first forming chamber, second dividing knife means and forming shoe means at said second working station of each turning wheel for dividing said first compressed fish block and forming a first pair of can-sized cakes, means for packing said first pair of can-sized cakes carried by each turning wheel downwardly into horizontally oriented cans, second transfer means positioned at said third working station of each turning wheel for pushing said second compressed fish block out of said second forming chamber, third dividing knife means and forming shoe means at said third working station of each turning wheel for dividing said second compressed fish block and forming a second pair of can-sized cakes, and means for packing said second pair of can-sized cakes carried by each turning wheel downwardly into horizontally oriented cans.

18. The apparatus of claim 17 wherein each of said turning wheels has four work stations spaced at 90° intervals.

19. The apparatus of claim 17 further comprising can star wheel means adjacent said second and third work stations of each of said turning wheels for supplying empty cans to be filled and for removing filled cans.

20. The apparatus of claim 19 wherein each of said can star wheel means comprises four work stations and moves intermittently between said four work stations.

* * * * *

UNITED STATES PATENT AND TRADEMARK OFFICE

CERTIFICATE OF CORRECTION

PATENT NO. : 6,622,458 B2
DATED : September 23, 2003
INVENTOR(S) : Otto H. Fischer et al.

It is certified that error appears in the above-identified patent and that said Letters Patent is hereby corrected as shown below:

Title page,
Item [73], the address of the Assignee should be changed from "Pueblo, CA (US)" to -- Pueblo, CO (US) --

Signed and Sealed this

Ninth Day of December, 2003

JAMES E. ROGAN
*Director of the United States Patent and Trademark Office*